United States Patent [19]

Mack

[11] Patent Number: 4,747,510

[45] Date of Patent: May 31, 1988

[54] TEAR OPEN LID

[75] Inventor: Anthony C. Mack, North Reading, Mass.

[73] Assignee: Fort Howard Cup Corporation, Green Bay, Wis.

[21] Appl. No.: 70,218

[22] Filed: Jul. 6, 1987

[51] Int. Cl.[4] ..... B65D 17/34

[52] U.S. Cl. ..... 220/270; 220/306; 220/380; 206/519; 206/508

[58] Field of Search ..... 220/270, 269, 306, 380; 215/256; 206/508, 519, 628, 45.32

[56] References Cited

U.S. PATENT DOCUMENTS

| | | | |
|---|---|---|---|
| 3,073,477 | 12/1963 | Betner | 206/604 |
| 3,159,303 | 12/1964 | Betner | 206/628 |
| 3,391,852 | 7/1968 | Waldrop | 229/43 |
| 3,515,334 | 6/1970 | Jacobson | 229/43 |
| 3,572,579 | 5/1971 | Mueller | 229/43 |
| 3,773,207 | 11/1973 | Dokoupil et al. | 220/270 |
| 3,836,039 | 9/1974 | Seiferth et al. | 220/270 |
| 3,980,224 | 9/1976 | Yasuda | 206/628 |
| 3,981,401 | 9/1976 | Blanchard | 206/508 |
| 4,091,930 | 5/1978 | Buchner et al. | 215/256 |
| 4,184,605 | 1/1980 | Hanson | 220/269 |
| 4,250,129 | 2/1981 | Winstead | 264/37 |
| 4,305,517 | 12/1981 | Dennis | 215/256 |
| 4,307,049 | 12/1981 | Winstead | 264/37 |
| 4,362,252 | 12/1982 | Graff | 220/270 |
| 4,386,706 | 6/1983 | Korte | 206/628 |
| 4,452,356 | 6/1984 | Dahl | 206/45.32 |
| 4,487,329 | 12/1984 | Winstead | 220/276 |
| 4,518,096 | 5/1985 | Winstead | 220/268 |
| 4,687,117 | 8/1987 | Terauds | 220/306 |
| 4,705,172 | 11/1987 | Gage | 220/380 |

*Primary Examiner*—George T. Hall

*Attorney, Agent, or Firm*—Nixon & Vanderhye

[57] ABSTRACT

A disposable plastic lid including a depending skirt formed with stacking, sealing and snap rings, and a pull tab at the lowermost edge of the skirt. The lid is formed such that the plastic is uniaxially oriented in a first direction and the tab is located to initiate a tear in a second direction transverse to the first direction. Tearing is also facilitated by notching the pull tab at either end thereof, and by providing a surface projection interrupting the snap ring in an area immediately adjacent the pull tab.

31 Claims, 2 Drawing Sheets

FIG. 1
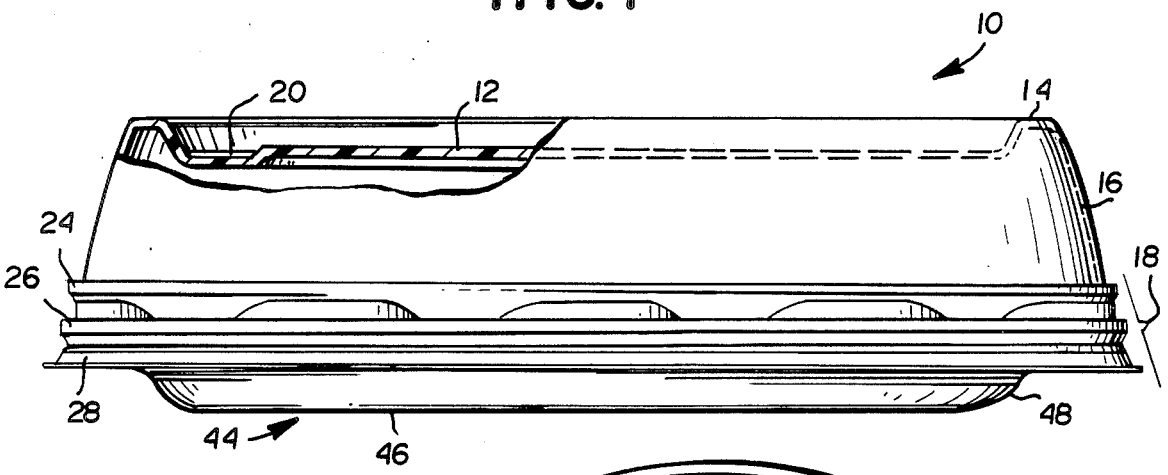
FIG. 2
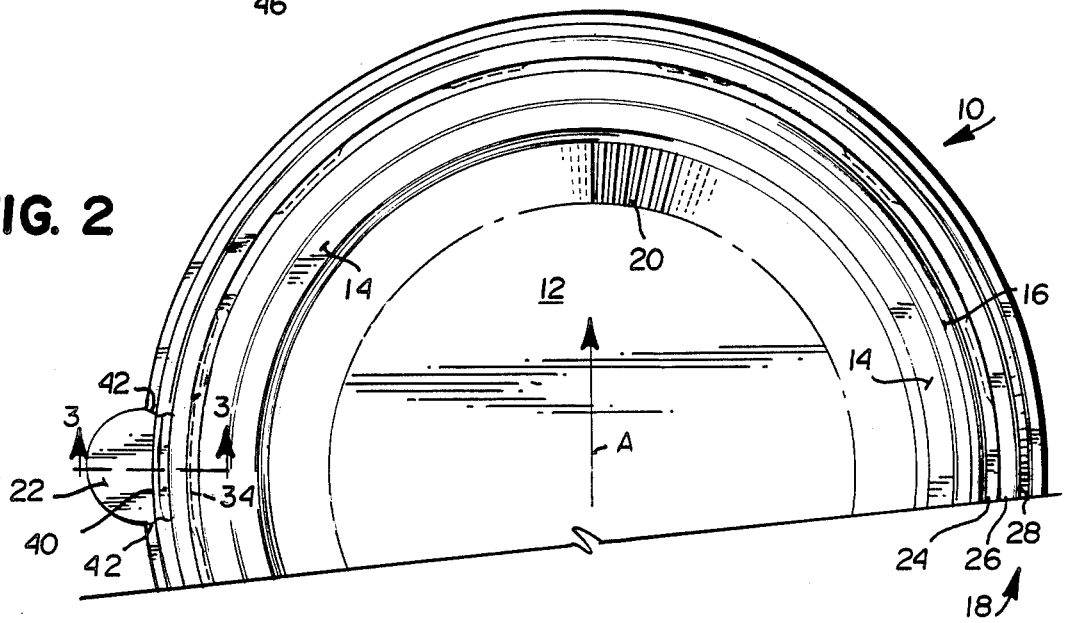
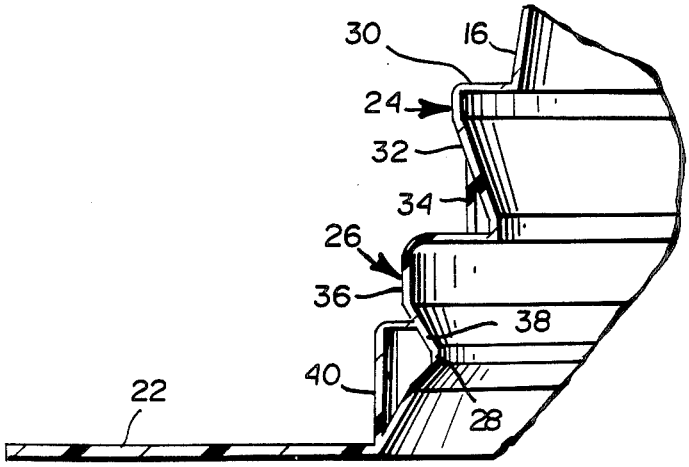
FIG. 3

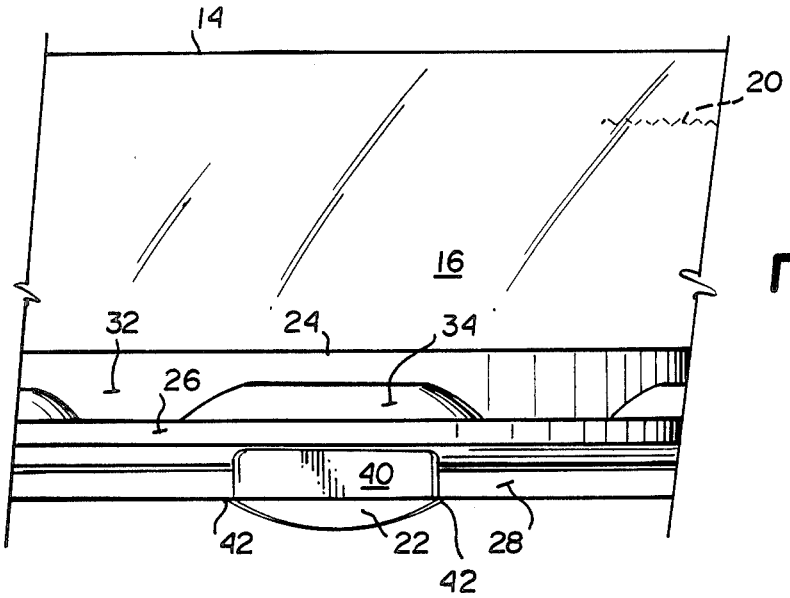
FIG. 4
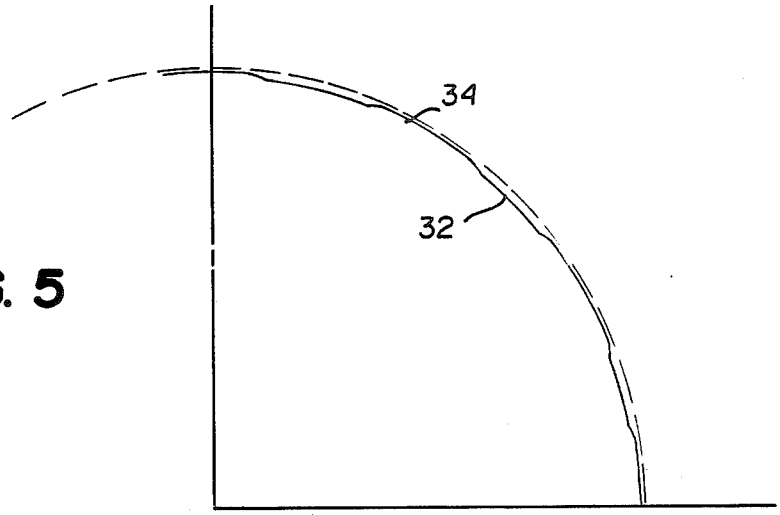
FIG. 5
FIG. 6
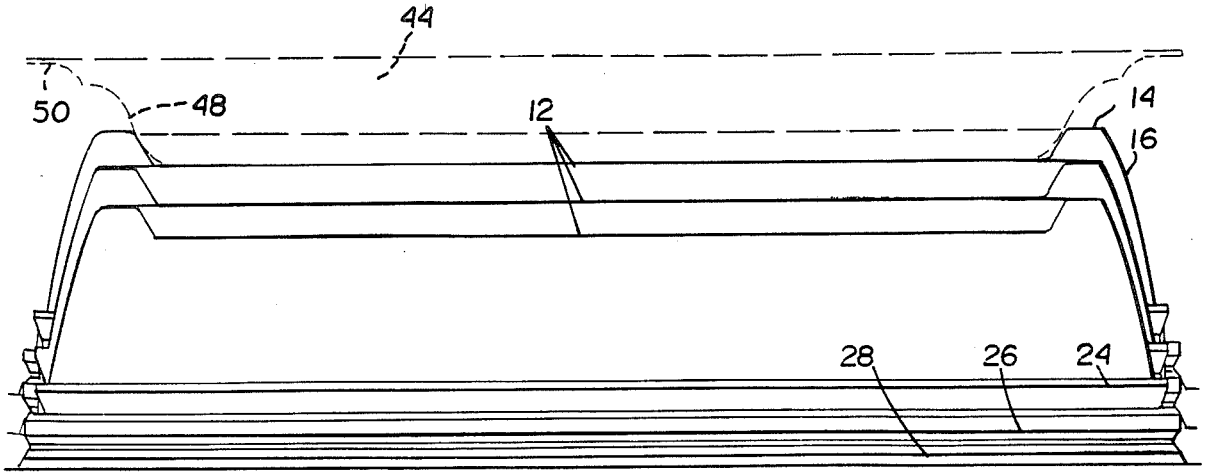

TEAR OPEN LID

BACKGROUND AND SUMMARY OF THE INVENTION

This invention relates to disposable containers or receptacles and associated lids of the type utilized for packaging "take-out" food products in restaurants, and the like. Such containers are often in the form of relatively shallow plates, and the associated lids are designed for removable attachment thereto to cover, protect, and retain heat (or cold) in the packaged food products.

Removal of the lids of such containers is often awkward, if not difficult. Moreover, with respect to many of such containers where the associated lid extends downwardly over the peripheral edge of the plate, it is a difficult task to remove the lid without also spilling the packaged contents. This is because the plate or container has little depth (or sidewall) which could otherwise be held with one hand while the lid is pried off with the other. It is also due in part to the effort required to remove the lid, and the unstable, or tilted, orientation of the container which is necessary to effectively exert such effort. In the prior art, several attempts have been made to overcome this and other related problems. For example, it is known to provide food containers with covers formed with rupturable, cut score lines in conjunction with an associated pull tab so that the cover can be torn off in a predetermined pattern. Configurations of this type are disclosed in U.S. Pat. Nos. 4,386,706; 4,184,605; 3,773,207; 3,572,579; 3,515,334; and 3,159,303.

In U.S. Pat. No. 3,391,852, a container construction is disclosed which includes a substantially planar lid held in place on the container by a peripheral fold-over flange.

In U.S. Pat. No. 3,836,039, an easy opening arrangement is provided for rigid or semi-rigid plastic sheet material wherein a tab is integrally formed in the cover, the tab being defined by a score line but wherein a portion of the tab is completely severed from the sheet material and covered with a patch of pressure-sensitive tape.

In U.S. Pat. Nos. 4,362,252 and 3,073,477 there are disclosed plastic containers having tear-off covers provided with pull tabs which act in conjunction with additional structure, excluding score lines, such that the cover will tear away from the container in a destructive first use.

In U.S. Pat. No. 3,980,224, opening means for containers and packages are disclosed wherein a cover, which may be sealed to an associated container, is constructed of a sheet containing at least one crystalline thermoplastic high molecular resin layer, the resin layer being partially uniaxially oriented, and further including an integral tab arranged to be pulled up in the uniaxially oriented direction whereby the sheet-like lid is torn into two parts.

In the present invention, a disposable container and associated lid of simplified construction are disclosed, wherein the lid is easily removable without any danger of spilling the contents of the container, because the container may be held in a level orientation with only minimal force required to remove the lid. At the same time, until the lid is removed, a liquid tight, or leak-resistant sealing relationship is maintained between the lid and the container to prevent leakage or seepage of food liquids (gravies, juices, etc.) when the lidded container is transported from point-of-purchase to destination.

In another aspect of the present invention, the disposable lids, as well as assembled containers and lids, are stackable to facilitate shipping, storage, etc.

In an exemplary embodiment of the invention, a lid is formed with a generally planar, sunken area, surrounded by an upstanding rim and a depending, peripheral skirt. The lower portion of the skirt is formed with a specific profile which includes a stacking ring for permitting stacking of a plurality of individual lids; a sealing ring for establishing a liquid tight or leak resistant seal between the lid and the outer peripheral edge of an associated plate-like container; and a snap ring for initially engaging and holding the plate and lid in assembled relationship. In addition, the lid is provided with an integral pull tab extending outwardly from the lowermost edge of the lid.

The lid is further provided with three distinct means by which tearing of the lid in a generally predetermined fashion is assured upon upward pulling of the integrally formed tab.

The first of these relates to the plastic material of which the lid is constructed. In a preferred embodiment, the lid is composed of an amorphous polymer, such as impact polystyrene. Another suitable plastic material is a styrene-butadiene copolymer known as K-resin TM, made by Phillips Petroleum. The lid may also be constructed of a blend of K-resin TM and general purpose polystyrene (no impact) which is advantageous in that it is less costly than 100% K-resin TM, and tends to be more susceptible to orientation stresses, thus enabling the tab to work more easily. It is known that the molecules of such plastic materials tend to uniaxially orient themselves in the direction in which they are pulled from the plastics forming machine, and that the plastic is very weak in a direction transverse to the orientation direction. Accordingly, the disposable lid is formed with the molecules oriented such that the lid is susceptible to tearing upon upward pulling on the tab, thus enabling easy removal from the container, with little if any likelihood of spillage.

Tearing is also facilitated by the incorporation of a rectangular projection at the interface of the pull tab and the depending skirt. This projection, in effect, interrupts or erases the snap ring along an area substantially commensurate with the width of the pull tab. The immediate effect of this arrangement is to eliminate the need for the tear to extend through the tortuous cross-section of the lid at the snap ring, and to direct the tear substantially vertically upwardly.

Finally, tearing of the lid is facilitated by a slight notching on either side of the pull tab which eliminates the need for the strong force normally required to at least initiate tearing action.

Accordingly, the present invention provides a simple, inexpensive, disposable lid and container for food products and the like, which maintains an effective liquid tight or leak resistant seal between the container contents and the exterior environment, and which is easy to remove with virtually no danger of spillage.

Other objects and advantages of the subject invention will become apparent from the detailed description of the invention which follows.

BRIEF DESCRIPTION OF THE DRAWINGS

FIG. 1 is a side view partially cut away of a disposable lid in accordance with this invention, and shown in assembled relationship with an associated container;

FIG. 2 is a partial top plan view of a disposable lid in accordance with the invention;

FIG. 3 is an enlarged cross-sectional view of a portion of the lid taken along the line 3—3 of FIG. 2;

FIG. 4 is a partial front view of a disposable lid in accordance with this invention, and illustrating an area of the lid where a pull tab extends outwardly from a skirt portion of the lid;

FIG. 5 is a partial top view, in schematic form, of a stacking ring provided in the disposable lid in accordance with the invention; and FIG. 6 is a side schematic view illustrating a plurality of individual lids of the type shown in FIG. 1 in stacked relationship, and showing, in phantom, the manner in which an associated container may be stacked on top of a lid.

DETAILED DESCRIPTION OF THE INVENTION

Referring now to FIGS. 1 and 2 in particular, there is illustrated a disposable, tear-away lid in accordance with an exemplary embodiment of the invention. The lid 10 is formed with a sunken center or well portion 12, also known as a "well", which is surrounded by an upstanding annular rim 14 and a peripheral depending skirt 16. The depending skirt flares outwardly and downwardly to a profiled lower edge 18 formed with a series of integral grooves and/or projections which will be described in further detail hereinbelow.

The outer peripheral portion of the depressed or sunken center portion 12 is provided with a series of ribs 20, as best seen in FIGS. 1 and 2. These are provided primarily for decorative purposes, although they do tend to add some rigidity to the center portion of the lid. It will be understood from FIG. 6 that the center portion or well 12 is designed to receive, in stacking relationship, the bottom portion of an associated container. In this way, assembled containers and lids may be vertically stacked in a stable and space saving manner.

With reference to FIG. 2, a pull tab 22 is provided at a lowermost edge of the depending skirt 16. The tab is shown to have a semi-circular shape, although other shapes may be employed with equal effectiveness. The width of the tab at the juncture of the tab with depending skirt 16 is on the order of one inch for a nine inch diameter lid, although this proportion may be varied.

With additional reference to FIG. 3, it may be seen that the profiled lower edge 18 of the depending skirt 16 is provided with an annular stacking ring 24, an annular sealing ring 26 provided just below the stacking ring 24, and an inwardly directed snap ring or groove 28 below the sealing ring 26. From the inwardly directed snap ring 28, the depending skirt extends downwardly and radially outwardly to its lowermost free edge.

The stacking ring 24 includes a horizontally, outwardly extending ledge 30 and a lower inwardly extending undercut portion 32. The undercut portion 32 is relieved about the circumference of the stacking ring by a series of circumferentially spaced, outwardly directed scallops 34 as best seen in FIGS. 3, 4 and 5. These relief portions, or scallops, eliminate the reverse angle or undercut over about 50% of the circumference of the stacking ring. This allows the lid to be stripped from the mold during its manufacture. At the same time, however, sufficient surface area is provided to enable effective stacking.

The sealing ring 26 includes an annular substantially vertical portion 36 and an undercut portion 38. The undercut portion of the sealing ring 26 partially defines the inwardly snap ring 28. In addition, the sealing ring 26 has an outer diameter in the vertical portion 36 which is slightly smaller than the outer diameter of the associated container or plate. In this way, a liquid tight or leak-resistant relationship is established between the container and the disposable lid when the lid is pressed over the plate so that the peripheral edge thereof snaps past ring 28 and is pressed beyond the undercut 38 and up into the sealing area 36.

It will be thus understood that the ring 28 serves only to hold the plate and lid initially in a somewhat loose, non-sealing relationship.

As best seen in FIGS. 3 and 4, the snap ring 28 is interrupted in an area adjacent the pull tab 22 by a projection 40. The projection 40 is generally rectangular in shape and protrudes radially outwardly, beyond the outer diameter of the snap ring and vertically downwardly to the point of merger of the pull tab and depending skirt. The projection serves primarily to permit the tear to travel directly upwardly into the depending skirt portion without having to follow the tortuous path of the snap ring cross-section. The projection also adds to the rigidity of the depending skirt adjacent the pull tab without increasing the force necessary to initiate the tear which propagates upwardly, alongside the projection.

Referring now to FIG. 2, it may be seen that the pull tab 22 is slightly notched at 42 on either side thereof where the pull tab meets the lowermost edge of the depending skirt. Notching the pull tab at these circumferentially spaced points insures that tearing will commence in a predetermined location, and eliminates the need for any relatively strong force otherwise required to initiate tearing of the plastic material.

The preferred material for construction of the disposable lid of this invention is an amorphous polymer which may be opaque impact polystyrene, or a styrene butadiene copolymer, such as the clear resin known as K-resin TM made by Phillips Petroleum, or a blend of K-resin TM with general purpose polystyrene. The molecules of these materials orient themselves uniaxially in the direction of extrusion, or the direction in which the plastic material is pulled from a mold or die, and the like. As a result, the plastic material is very weak in a direction transverse to the uniaxial orientation of the molecules. In the context of this invention, the pull tab 22 is located transverse to the machine direction of extrusion, which is indicated by the arrow A in FIG. 2. This configuration renders the lid easily tearable in an upward direction, and allows the tear to propagate from the free edge of the depending skirt, to at least the annular upstanding rim 14. Once torn upward, a finger can be placed on the rim of the plate to hold it down while the lid is fully removed.

It may thus be appreciated that there are at least three features of the disclosed invention which facilitate tearing of the disposable lid. The first and foremost aspect is the uniaxial molecular orientation of the thermoplastic material about the circumferential direction of the depending skirt. In addition, and with reference to FIGS. 3 and 4, the rectangular projection 40 which is centered with respect to the pull tab 22, enables tearing to extend upwardly through the depending skirt without following torturous path which would otherwise be followed by reason of the inwardly projecting snap ring 28. At the same time, and as best seen in FIG. 2, notches 42 are provided at the juncture of the pull tab means and the depending skirt. As a result, only slight upward pulling on the tab results in tearing of the disposable lid which thereby enables easy removal of the lid from the container.

FIG. 1 also illustrates an associated container in assembled relationship with the disposable lid 10. The container 44, includes a substantially planar base 46, a peripheral upwardly and outwardly extending wall 48, and an outwardly extending flange 50 (see FIG. 6). As previously described, flange 50 fits snugly within the sealing ring 26 to create a liquid tight seal between the lid and the container. This, of course, assures retention of heat and liquid within the container even in the event of severe tilting of the package, particularly during transport.

In FIG. 6, a plurality of the disposable lids of this invention are shown in stacked arrangement, illustrating how the stacking rib 24 supports an adjacent disposable lid. In addition, FIG. 6 illustrates an associated container 44 received within the sunken center portion 12 of the container 10. In this regard, it may be desirable to vertically stack assembled lids and containers, already containing food therein, at the point of sale, for example.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

I claim:

1. A disposable lid for use with a container said lid comprising a top surface portion surrounded by depending skirt means, said depending skirt means including a pull tab extending outwardly from a lowermost edge of said depending skirt means, and wherein said depending skirt means includes plural means facilitating tearing of said lid in a first direction, upon upward exertion of force on said pull tab, and wherein said tear facilitating means do not include score lines.

2. A disposable lid as defined in claim 1 wherein said lid is formed of an amorphous polymer, and wherein said means facilitating tearing includes a uniaxial orientation of molecules of said amorphous polymer in a direction substantially transverse to said first direction.

3. A disposable lid as defined in claim 1 wherein said means facilitating tearing includes notch means formed at either end of said pull tab at the juncture of said pull tab and said depending skirt means.

4. A disposable lid as defined in claim 1 wherein said depending skirt means is formed with at least one radially inwardly directed groove extending about substantially the entire periphery of said depending skirt means, said tear facilitating means including surface means interrupting said groove in a circumferential portion of said groove adjacent said pull tab.

5. A disposable lid as defined in claim 2 wherein said means facilitating tearing also includes notch means formed at either end of said pull tab at the juncture of said pull tab and said depending skirt means.

6. A disposable lid as defined in claim 2 wherein said depending skirt means is provided with a sealing ring, and at least one groove defining a snap ring extending about substantially the entire periphery of said depending skirt means, said tear facilitating means also including surface means interrupting said groove in a circumferential portion of said groove adjacent said pull tab.

7. A disposable lid as defined in claim 3 wherein said depending skirt means is formed with at least one groove extending about substantially the entire periphery of said depending skirt means, said tear facilitating means also including surface means interrupting said groove in a circumferential portion of said groove adjacent said pull tab.

8. A disposable lid as defined in claim 5 wherein said depending skirt means is formed with at least one groove extending about substantially the entire periphery of said depending skirt means, said tear facilitating means also including surface means interrupting said groove in a circumferential portion of said groove adjacent said pull tab.

9. A disposable lid as defined in claim 1 wherein said depending skirt means is further provided with an annular stacking ring for facilitating stacking of a plurality of said lids.

10. A disposable lid as defined in claim 1 wherein said depending skirt means is further provided with a sealing ring for establishing a liquid tight relationship between said lid and an associated container.

11. A disposable lid as defined in claim 1 wherein said lid is formed of an amorphous polymer, and wherein said depending skirt means is formed with a stacking ring, a sealing ring, and at least one groove defining a snap ring extending about substantially the entire periphery thereof; said tear facilitating means including:

(a) a uniaxial orientation of molecules of said amorphous polymer in a direction substantially transverse to said first direction;

(b) notch means formed at either end of said pull tab means at the juncture of said pull tab means and said depending skirt means; and (c) surface means interrupting said snap ring in a circumferential portion of said snap ring adjacent said pull tab.

12. A disposable lid as defined in claim 11 wherein said amorphous polymer comprises a styrene butadiene copolymer and polystyrene blend.

13. A disposable lid as defined in claim 4 wherein said surface means interrupting said groove comprises a substantially rectangular projection protruding outwardly from said skirt means and in substantial vertical alignment with said pull tab means.

14. A disposable lid as defined in claim 13 wherein said depending skirt means is further provided with an annular sealing ring and an annular stacking ring, said stacking ring having an undercut portion which is partially relieved by a plurality of circumferentially spaced scalloped portions, one of said portions being centered with respect to said pull tab means and said substantially rectangular projection.

15. A disposable lid as defined in claim 6 wherein said sealing ring is at least partially undercut about its circumferential surface, said undercut portion partially defining said radially inwardly directed groove.

16. A disposable lid as defined in claim 2 wherein said top surface portion comprises an annular, depressed portion connected to said depending skirt means by an annular, upstanding rib.

17. A disposable lid as defined in claim 16 wherein said depressed portion is sized to accommodate a bottom portion of a container of the type designed to be closed by said lid, so that assembled lid and container units may be stacked.

18. A disposable lid as defined in claim 11 wherein said amorphous polymer comprises impact polystyrene.

19. A disposable lid as defined in claim 11 wherein said amorphous polymer comprises a styrene butadiene copolymer.

20. A one-piece disposable lid for application to an open-ended receptacle comprising:

a substantially planar surface surrounded about its outer periphery by depending skirt means, said skirt means provided with first radially outwardly extending projection means for enabling vertical stacking of a plurality of lids;

second radially outwardly extending projection means for sealing said lid to an associated receptacle; and third radially inwardly extending projection means for enabling snap-fit engagement between said lid and an associated container; wherein an integral pull tab is provided at the lowermost edge of said depending skirt means, said pull tab merging with surface means interrupting said third projection means.

21. A lid as defined in claim 20 wherein said lid is formed of an amorphous polymer, molecules of which are oriented in a first direction such that, upon upward pulling of said pull tab means, said lid tears in a second direction transverse to said first direction.

22. A lid as defined in claim 21 wherein said amorphous polymer comprises impact polystyrene.

23. A lid as defined in claim 21 wherein said amorphous polymer comprises a styrene butadiene copolymer.

24. A disposable lid comprising a substantially planar central portion surrounded by a depending skirt provided with a substantially annular snap ring adjacent its lowermost edge for holding said lid in closed relationship with an associated open-ended receptacle, said lid further including pull tab means extending from said lowermost edge and merging with a surface projecting from said snap ring.

25. A disposable lid as defined in claim 24 wherein said lid is formed of an amorphous polymer, molecules of which are oriented in a first direction such that, upon upward pulling of said pull tab means, said lid tears in a second direction transverse to said first direction.

26. A disposable lid as defined in claim 25 wherein said amorphous polymer comprises impact polystyrene.

27. A disposable lid as defined in claim 25, wherein said amorphous polymer comprises a styrene butadiene copolymer.

28. In combination with the disposable lid of claim 1, an open-ended receptacle comprising a substantially planar base portion, a generally upwardly inclined peripheral wall, and an outwardly directed flange, said flange adapted for sealing engagement with said depending skirt means.

29. In combination with the disposable lid of claim 20, an open-ended receptacle comprising a substantially planar base portion, a generally upwardly inclined peripheral wall, and an outwardly directed flange, said flange adapted for sealing engagement with said second outwardly extending projection means.

30. In combination with the disposable lid of claim 24, an open-ended receptacle comprising a substantially planar base portion, a generally upwardly inclined peripheral wall, and an outwardly directed flange, said flange adapted for sealing engagement with said depending skirt means.

31. A disposable lid for use with a container said lid comprising a top surface portion surrounded by depending skirt means, said depending skirt means including a pull tab extending outwardly from a lowermost edge of said depending skirt means, and wherein said depending skirt means includes plural means facilitating tearing of said lid in a first direction, upon upward exertion of force on said pull tab, wherein said lid is formed of an amorphous polymer, and wherein said depending skirt means is formed with a stacking ring, a sealing ring, and at least one groove defining a snap ring extending about substantially the entire periphery thereof; and where said tear facilitating means comprises (a) a uniaxial orientation of molecules of said amorphous polymer in a direction substantially transverse to said first direction; (b) notch means formed at either end of said pull tab means at the juncture of said pull tab means and said depending skirt means; and (c) surface means interrupting said snap ring in a circumferential portion of said snap ring adjacent said pull tab.

* * * * *